US005581920A

United States Patent [19]

Hydary

[11] Patent Number: 5,581,920

[45] Date of Patent: Dec. 10, 1996

[54] PERPETUAL CALENDAR

[76] Inventor: Mainul H. Hydary, Apt. 405, 1570 Lawrence Avenue West, North York, Ontario, Canada, M6L 1C2

[21] Appl. No.: 329,939

[22] Filed: Oct. 27, 1994

[51] Int. Cl.[6] ..... G09D 3/06

[52] U.S. Cl. ..... 40/114; 40/111; 40/358

[58] Field of Search ..... 40/107, 111, 114, 40/358, 503, 506; 283/2, 3

[56] References Cited

U.S. PATENT DOCUMENTS

| | | | |
|---|---|---|---|
| 217,433 | 7/1879 | Trum . | |
| 239,867 | 4/1881 | Smith . | |
| 256,396 | 4/1882 | Smith . | |
| 724,980 | 4/1903 | Widders | 40/335 |
| 728,904 | 5/1903 | Graessle . | |
| 2,567,395 | 9/1951 | Peterson, Jr. | 40/111 |
| 3,468,048 | 9/1969 | Smith . | |
| 3,765,111 | 10/1973 | Spicer | 40/111 |
| 4,376,346 | 3/1983 | Nelson | 40/111 X |

FOREIGN PATENT DOCUMENTS

| | | |
|---|---|---|
| 651428 | 2/1929 | France . |
| 3103650 | 2/1982 | Germany . |
| 1250871 | 10/1971 | United Kingdom . |

*Primary Examiner*—Brian K. Green
*Attorney, Agent, or Firm*—Peter R. Hammond; Barrigar & Moss

[57] ABSTRACT

A perpetual calendar has a cylindrical outer casing having several viewing apertures formed therein. The casing displays on an outer surface thereof in seven vertical columns the dates of the month from one to twenty-eight. One of the apertures is positioned to display up to three additional dates of the month after the numeral 28. An inner cylinder is rotatably mounted in the outer casing and coaxial therewith. This cylinder displays on an exterior surface thereof the 12 months of the year and also month ending date or dates for months having more than 28 days. This cylinder is rotatable to display the current month through one aperture and correct month ending date or dates for that month through another aperture. Also, a ring is mounted for rotation in the outer casing and is coaxial with this casing. The ring displays on its exterior surface data for indicating days of the week. Preferably the device is also capable of displaying through apertures of the casing data relating to zodiac signs for the indicated month.

17 Claims, 3 Drawing Sheets

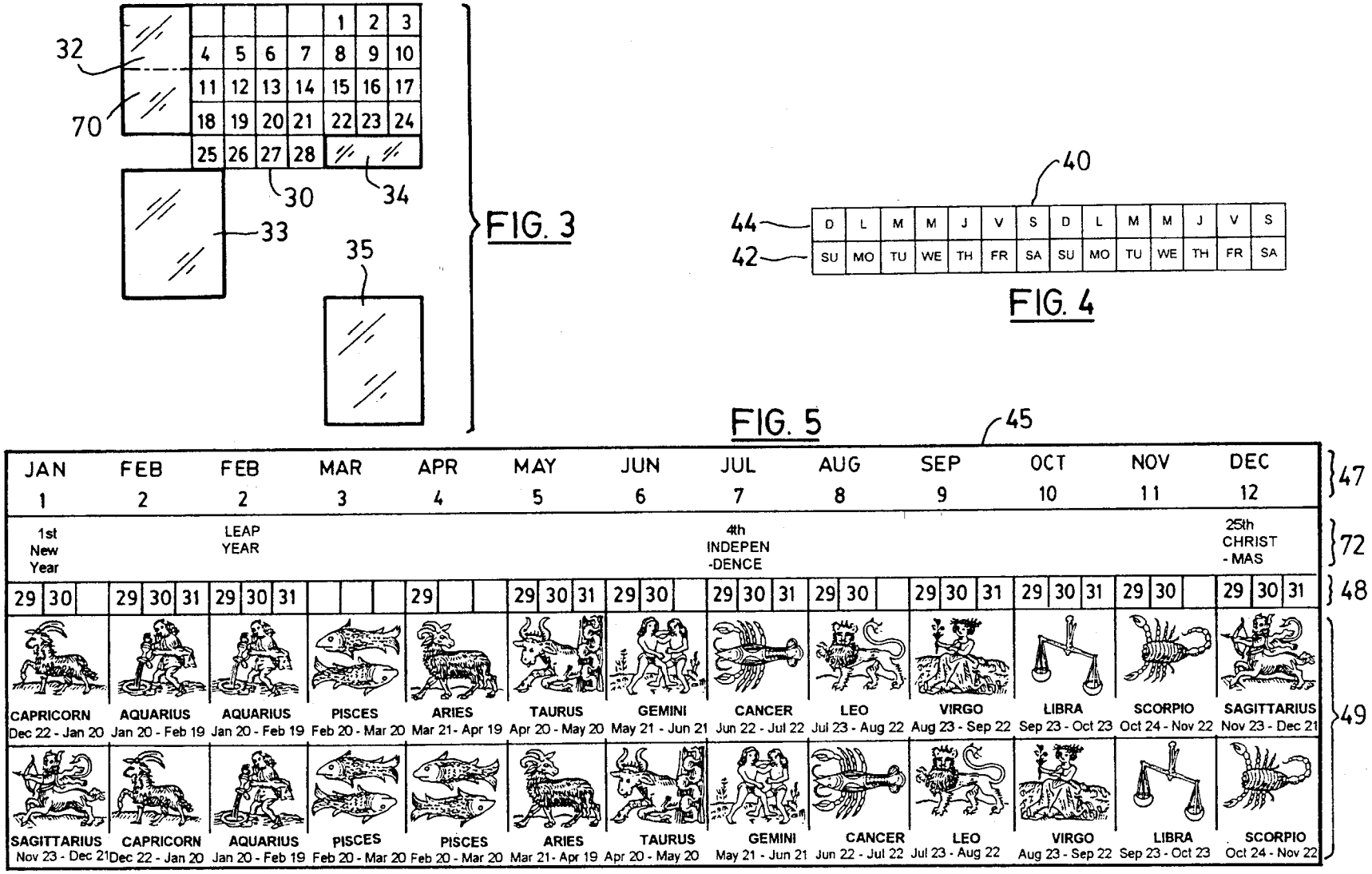
FIG. 3
FIG. 4
FIG. 5
32
70
30
33
34
35
40
42
44
45
47
48
49
72
D L M M J V S D L M M J V S
SU MO TU WE TH FR SA SU MO TU WE TH FR SA
JAN FEB FEB MAR APR MAY JUN JUL AUG SEP OCT NOV DEC
1st New Year
LEAP YEAR
4th INDEPEN -DENCE
25th CHRIST -MAS
CAPRICORN Dec 22 - Jan 20
AQUARIUS Jan 20 - Feb 19
AQUARIUS Jan 20 - Feb 19
PISCES Feb 20 - Mar 20
ARIES Mar 21 - Apr 19
TAURUS Apr 20 - May 20
GEMINI May 21 - Jun 21
CANCER Jun 22 - Jul 22
LEO Jul 23 - Aug 22
VIRGO Aug 23 - Sep 22
LIBRA Sep 23 - Oct 23
SCORPIO Oct 24 - Nov 22
SAGITTARIUS Nov 23 - Dec 21
SAGITTARIUS Nov 23 - Dec 21
CAPRICORN Dec 22 - Jan 20
AQUARIUS Jan 20 - Feb 19
PISCES Feb 20 - Mar 20
ARIES Mar 21 - Apr 19
TAURUS Apr 20 - May 20
GEMINI May 21 - Jun 21
CANCER Jun 22 - Jul 22
LEO Jul 23 - Aug 22
VIRGO Aug 23 - Sep 22
LIBRA Sep 23 - Oct 23
SCORPIO Oct 24 - Nov 22
SCORPIO Oct 24 - Nov 22

PERPETUAL CALENDAR

FIELD OF THE INVENTION

The invention relates to the field of calendars and, more particularly, to perpetual calendar systems.

BACKGROUND OF THE INVENTION

Perpetual calendars are calendars which can be used year after year by simply setting the calendar in the appropriate position for the current year. Thus, perpetual calendars are convenient devices to own and use. A number of mechanical perpetual calendar systems are known in the art, ranging from complex mechanical machinery to simpler card-based systems.

U.S. Pat. No. 217,433 issued Jul. 8, 1979 to E. J. Trum discloses a perpetual calendar comprising a fixed base card onto which is marked days of the month in rows, ie. in calendar form. Two strips of removable cards lie above and below the base card and have printed on them the month, year and days of the week. One strip indicates the month last past and the other strip the current month. The days of the week marked on the strips are aligned with the rows of the days of the month marked on the base card. As the months expire, the topmost card of each strip is removed to show the next cycle of the current and past month and the days of the week appropriately aligned with the days of the month on the base card. Eventually, of course, the strips need to be replenished.

U.S. Pat. No. 239,867 issued Apr. 5, 1881 to J. G. Smith describes a calendar ink stand having a nose around which is arranged a band having on its outer surface the days of the week arranged in order and can be turned, as required. The top of the ink stand is divided into five concentric rings and seven sectors in order to display the days of the month from 1 to 31. On the bottom of the ink stand there is a rim and located concentrically therein is a band having the names of the month displayed on the outer surface thereof. The proper month can be exposed at one point by means of a window in the rim. It is necessary for the user to always know how many days the current month has in order to be alerted thereon to change the day of the week setting to the first of the next month.

U.S. Pat. No. 256,396 issued Apr. 11, 1882 to J. G. Smith discloses a calendar ink flask wherein the days of the month are fixedly displayed on the side of the flask and the current month is displayed through a window in the base of the flask. On the neck of the flask lies an adjustable neck band having the days of the week arranged in order thereon. The neck band can be turned so as to bring the proper day of the week to correspond to the first of the month. It is necessary for the user to always know how many days the current month has in order to change the day of the week setting to the first of the next month at the appropriate time.

U.K. patent No. 1,250,871 published Oct. 20, 1971 to J. J. Robinson discloses a complex mechanical perpetual calendar system. The mechanical calendar comprises a casing formed with four viewing apertures and four annular gear units with data thereon rotatably mounted correspondingly to the casing so as to exhibit the data through the apertures. The first gear unit shows the year, the second the months of the year, the third the days of the week, and the fourth the date, i.e. numerical day of the month. Actuating means allow the first and third gear units to be selectively rotated independently of the second and fourth gear units to simultaneously alter the year numeral and day displayed. The second and fourth gear units can be rotated independently of the first and third gear units to simultaneously alter the month and date displayed. In order that the correct number of days be shown for the month, the calendar employs on the date gear unit four date covers, each comprising an arcuate strip provided with a rearward projection that extends through a horizontal throughslit formed in each date quadrant. This calendar, by virtue of its relatively complex mechanics, is a relatively expensive item to produce.

SUMMARY OF THE INVENTION

An object of one aspect of the invention is to provide a perpetual calendar at a low cost and yet still avoid deficiencies of the prior art.

According to one aspect of the invention, there is provided a perpetual calendar comprising an outer casing having at least first and second viewing apertures formed therein, said casing displaying on an exterior surface thereof in seven vertical columns dates of the month from the number "1" to the number "28", said second viewing aperture being positioned to display up to three additional dates of the month after the number "28", rotatable display means mounted in the outer casing for displaying the twelve months of the year and month ending date or dates for months having more than 28 days, this display means being rotatable to display the current month through the first viewing aperture and correct month ending date or dates for the current month through the second viewing aperture and a display member mounted in or on the outer casing for displaying data for indicating days of the week above the vertical columns of dates.

According to another aspect of the invention, a perpetual calendar device comprises an exterior casing having viewing apertures formed therein, the casing displaying on an exterior surface thereof dates of the month arranged in columns and a data display member mounted for rotation relative to the exterior casing and displaying on a surface adjacent the exterior casing data relating to zodiac signs, which data is arranged for viewing through the apertures, only selected portions of this data being visible through the apertures at any one time. The data displaying member can be rotated to display through the apertures data relating to a zodiac sign applicable to a particular month of the calendar year.

Preferably the perpetual calendar includes two windows or apertures in the housing for displaying zodiac sign information and the data displaying member or inner cylinder bears thereon two horizontal rows of zodiac sign information disposed so that the rows respectively show through the windows.

BRIEF DESCRIPTION OF THE DRAWINGS

The present invention will be understood and appreciated more fully from the following non-limiting detailed description, taken in conjunction with the drawings in which:

FIG. 3 is a schematic diagram of a layout for the days of the month as well as windows for showing the month of the year and zodiac signs for the month;

FIG. 4 is a schematic diagram of a printed layout for an annular ring, the layout indicating the days of the week in short form for both English and French; and FIG. 5 is a schematic diagram of a main printed layout for an inner cylinder, the layout showing month and zodiac sign information.

DETAILED DESCRIPTION OF THE DRAWINGS

Figure 1:
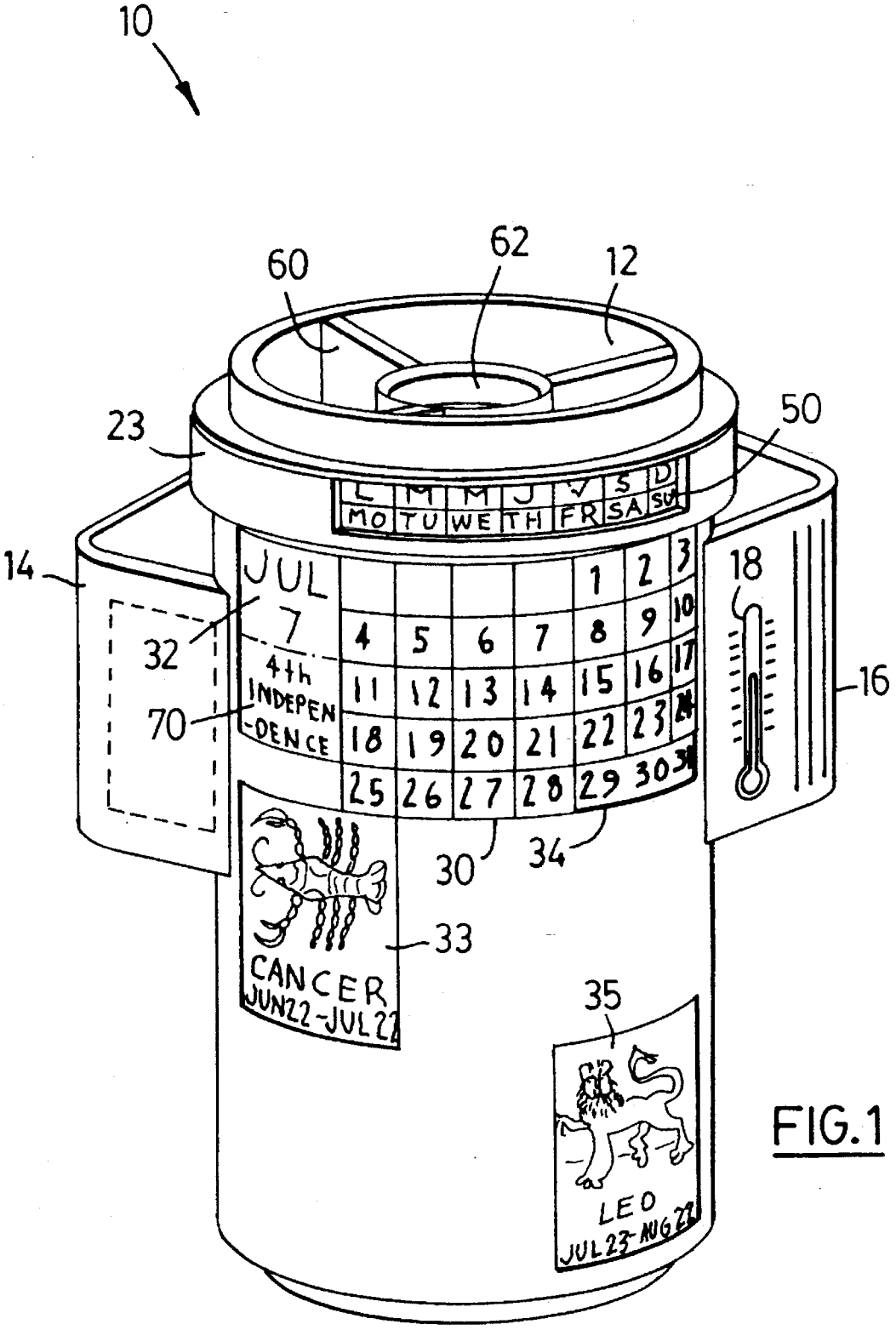
FIG. 1 is a perspective view illustration of one preferred embodiment of the perpetual calendar of the invention, which includes various supplementary holders.

FIG. 1 shows in perspective view a preferred embodiment of a perpetual calendar 10 which has a generally cylindrical shape. The calendar 10 preferably comprises supplementary holders including an open top chamber 12 for use as a pen and pencil holder, an outwardly projecting side extension or holder 14 for mounting and displaying a small photograph therein and a further side extension or holder 16 wherein a thermometer can be mounted. Of course, other uses may be made of these supplementary holders and the position of the side extensions 14, 16 may be varied so long as they do not interfere with the operation of the calendar itself.

Figure 2:
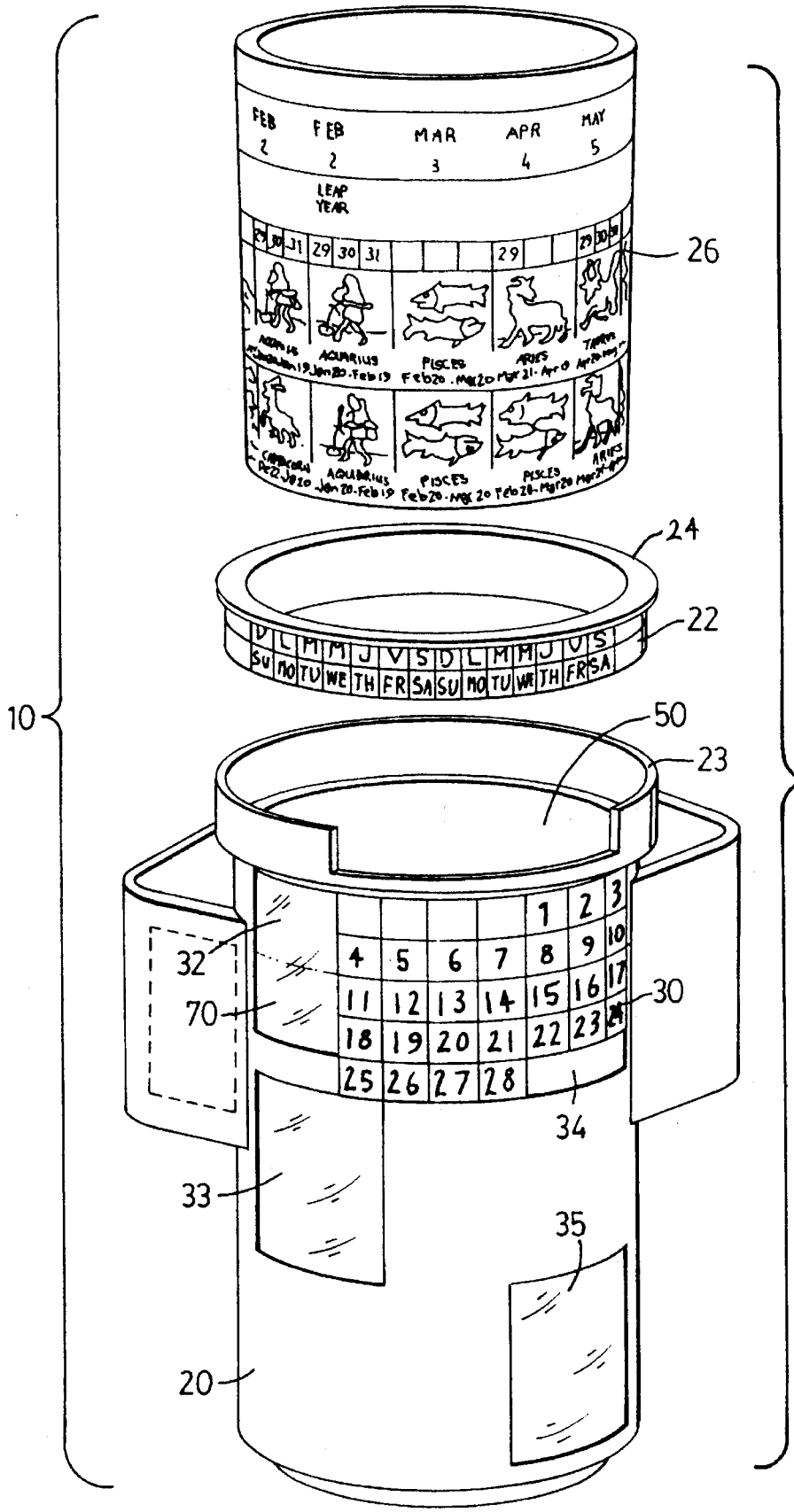
FIG. 2 is an exploded view diagram showing three components of the calendar depicted in FIG. 1.

Referring to FIG. 2, the calendar 10 includes three major separable components: a main cylindrical housing or outer casing 20 which may be cup shaped, an annular ring member 22 with an outwardly extending flange 24 at the top thereof, and an inner cylinder 26 open at the top thereof (preferably closed at the bottom thereof). The ring member 22 has an outer diameter sized to permit it to fit into the top of the housing 20. The flange 24 of the ring member 22 acts to seat it on an upper rim portion 23 of the housing. Similarly, the cylinder 26 has an outer diameter sized to permit it to slide through the ring member 22 and into the housing 20, with the flange 28 acting to seat the cylinder 26 on the ring member 22.

Mounted on the housing 20 is a calendar date chart 30 bearing the numbers 1 to 28 in five horizontal rows and seven vertical rows or columns. The numbers 1 to 3 can be in the first horizontal row while the final numbers 25 to 28 can be in the last horizontal row.

The housing 20 is equipped with preferably five windows or viewing apertures indicated by reference numerals 32 to 35 and 70. Each of windows 32 to 35 and 70 can either be an open window or covered with a clear plastic or glass so that it is transparent.

Referring additionally to FIG. 3, the layout for the date chart 30 and the windows 32 to 35 and 70 is shown more clearly. The window 32 is employed to display the current month, such as one of "May, June, July, etc.", and the number of the month, which in the case of the month of July is the number 7 since it is the seventh month. The windows or apertures 33 and 35 are employed to display the zodiac names and signs corresponding to the current calendar month, there being two zodiac signs applicable for each calendar month. The window 34 is situated proximate to the date chart 30 and employed to display "variable" ending dates of the calendar month since the calendar months do not all have an equal number of days. As shown in FIG. 1 for example for the month of July, which has 31 days, the numbers 29, 30 and 31 are displayed in the window 34 after the numeral "28".

The underlying information or data which is displayed through the windows 32–35 is shown in FIG. 5 (not drawn to scale). The information can be printed on a paper or plastic strip 45 which is wrapped around and affixed onto the outside of the inner cylinder 26. This information could also be printed or painted directly on the surface of the inner cylinder. The top portion of the strip 45, indicated by reference numeral 47, comprises a row of the names and numbers of the twelve months, of which one month's data is displayed through the window 32. The mid-portion of the strip 45, indicated by reference numeral 48, comprises a row of the variable ending date information for the calendar month which is displayed through the window 34. It will be appreciated that the row of the month ending date or dates is offset from the row of names and numbers of the months by a distance equal to the spacing between windows 32 and 34. Finally, the bottom portion of the strip 45, indicated by reference numeral 49, comprises two rows of the zodiac sign data or information which is displayed in windows 33 and 35. The rows of zodiac sign information can be offset therebetween by a distance equal to the spacing between windows 33 and 35 less the width of the space occupied in each row by the data for one zodiac sign.

It should be noted from FIG. 5 that the month of February and its number "2" are shown twice in top portion 47. In addition, the two zodiac signs that include the month of February, namely Aquarius and Pisces, are shown twice in one of the two horizontal rows. This is to accommodate leap years when February has 29 days instead of 28. The second February setting, if used, will result in the date number "29" appearing in the window 34. Also, in the preferred version, the words "leap year" will show up in the window 70.

Referring to FIG. 4, a paper or plastic strip 40 having printed thereon horizontal rows of data in the form of letters identifying days of the week is wrapped around and affixed to the ring member 22. Alternatively, the weekday letters can be printed directly on the ring member. The correct sequence of letters for the ring 22 is shown in FIG. 4 with the letter "MO" representing Monday, the letter "TU" representing Tuesday, etc. If a unilingual calendar is desired, one row of letters is sufficient. However, a second row of characters could be used to provide a second language weekday readout. For example, the first horizontal row indicated at 44 can be letters for the French language days of the week while the lower row 42 can be letters for the English language days of the week. In any event, the letters of the one or two rows can be viewed through a horizontally extending gap 50 which can be seen in FIG. 1. The gap 50 is formed by a break in the upper rim section 23 which projects upwardly and outwardly from the main housing 20. The gap permits the display of seven letters or letter combinations only (per horizontal row) representing the seven days of the week. These letters are displayed directly above the seven vertical rows of date numbers on the housing 20. The ring member 22 extends across the gap 50 to display the seven days of the week.

In use, the perpetual calendar of the invention must be set each month. To do so, one initially notes from another calendar the day of the week on which the first day of the current month falls. One then turns the annular ring member 22 until the correct day of the week is positioned directly above the number 1 (on the housing 20) representing the first day of the month. At the same time the inner cylinder 26 is turned so that the correct month appears in the window 32. Doing so will also cause the correct sequence of "variable dates" to appear in the window 34, thereby completing the date display for the current month. Additionally, the appropriate zodiac signs will appear in the windows 33 and 35. Having set the calendar 10 initially in this manner, at the end of the current month the day of the week upon which it falls is noted, and the calendar 10 is reset as described above to have the next day of the week aligned with the number 1 representing the first day of the next month. Thus, the calendar 10 may be perpetually reset without referring to an external calendar source unless one chooses to do so (after the initial setting by the user).

It will be appreciated by those skilled in the art that a perpetual calendar embodying one or more aspects of the invention need not have all of the features of the illustrated calendar shown in the drawings. For example, it is possible to construct a perpetual calendar which although capable of displaying through the aperture 34 the month ending date or dates, is not capable of displaying the additional 29th day for February in a leap year. The inability to display the 29th day for February would not seriously affect the usefulness of the calendar since this 29th day only appears once in four years. In such a version of the calendar it would only be necessary to display February once on the inner cylinder.

It is also possible, of course, to construct a useful perpetual calendar in accordance with one aspect of the invention wherein the zodiac sign information for the selected month is not displayed through windows or apertures. Thus, in one version of the invention, the apertures 33 and 35 could be omitted along with the zodiac sign information on the inner cylinder 26. On the other hand, it is also possible to construct a perpetual calendar which has the capability of displaying the zodiac sign information for the current month but which does not have a separate aperture, for example, for displaying the current month. The current month could, for example, be displayed through the same aperture as that used for the zodiac sign information. It is also possible to construct a perpetual calendar in accordance with the invention wherein all of the appropriate zodiac sign information for a particular month is shown through a single aperture or window. The advantage of showing the zodiac sign information through two separate windows is that it clearly separates the information relating to the two signs for the month and also the position of the two windows corresponds roughly to the location of the dates in the month for which the zodiac sign is appropriate. For example, the Capricorn sign is displayed in the upper lefthand aperture 33 during the month of January and this position corresponds roughly to the position of the initial 19 days in January for which the sign applies. Similarly, the Aquarius sign appears in the lower righthand aperture 35 during the month of January and this sign applies to the last 12 days of January.

In a particularly preferred embodiment of the inner cylinder, this cylinder is hollow and has several dividers or partitions 60 extending vertically and radially. These divide the inner cylinder into several compartments for holding a variety of objects. If desired, the divider 60 can extend inwardly to a small central cup 62 that might, for example, be used to hold an eraser or perhaps some paperclips.

In addition to having optional holders for photographs or a thermometer, the unused exterior surface of the outer casing can be used to display useful information such as conversion tables for distances, weights, temperatures, etc. This information could, for example, be displayed on the back of the outer casing opposite the calendar.

It will also be appreciated that it is possible to display the 12 months of the year and the month ending date or dates in a different manner than that shown in the drawings and described above. For example, it is possible for the 12 months of the year to be displayed on one rotating cylinder while the month ending date or dates is displayed on a separate rotating cylinder with both cylinders being mounted in the outer casing. Although such an arrangement is quite feasible, it might be less advantageous than the preferred embodiment illustrated in FIGS. 1 and 2, which embodiment always ensures that for every month displayed in aperture 32, the correct month ending date or dates will be shown in aperture 34. It is also conceivable that instead of having the month displayed by means of a rotating cylinder, the 12 months of the year could be shown on a rotating disk mounted in the outer casing in such a manner that again only one month of the year is displayed in any one time through a window or aperture.

Preferably the housing 20 has a closed bottom end so that objects or pens placed in the interior of the device will not fall through.

The additional aperture or window 70 is optional and can be provided in the outer casing for displaying a special day that month such as a national holiday or a religious date such as Christmas. As indicated, it also can be used to show "leap year" in the leap year month of February. This aperture can be located below the first aperture 32 for the month. As indicated by the dashed line in FIG. 3, the window area 70 need not be a separate window but it can be combined with the window 32 to form a single window displaying both the month and a special day in the month. These special days can be displayed on the inner cylinder in the horizontal strip region indicated at 72 in FIG. 5. A personal date such as a birthday could be written in in the region 72 or placed in the region by means of a sticker with the date printed thereon (not shown).

Also, the interior casing need not be completely cylindrical on its exterior. The housing 20 can be flattened on one side if desired while still retaining its cylindrical interior surface. This flattening may provide better viewing of a photo held in one side section of the housing or the thermometer.

It will be appreciated that the present invention is a relatively inexpensive item to produce. Additionally, leap years are accurately accounted for and no further accessories need to be purchased in order for the calendar to work perpetually, unlike some calendar systems of the prior art.

It will also be appreciated by persons skilled in the art that the present invention is not limited by what has been particularly shown and described herein. Rather, the scope of the present invention is defined only by the claims which follow.

I therefore claim:

1. A perpetual calendar device capable of displaying dates in a time period of a month and each of twelve months in a year, said device comprising:

a cylindrical outer casing having at least first and second viewing apertures formed therein, said casing displaying on an exterior surface thereof in seven vertical columns dates of the month from a numeral "1" to a numeral "28", said second viewing aperture being positioned to display up to three additional dates of the month after the numeral "28";

an inner cylindrical member mounted for rotation in said outer casing and coaxial therewith, said inner cylindrical member displaying on an exterior surface thereof the twelve months of a year and further displaying month ending date or dates for months having more than 28 days, said cylindrical member being rotatable to display a current month through said first viewing aperture and correct month ending date or dates for said current month through said second viewing aperture; and an annular member mounted for rotation in said outer casing and coaxial therewith, said annular member displaying on an exterior surface thereof data for indicating days of a week, said annular member being rotatable to align the days of the week data above appropriate vertical columns of dates for current month.

2. A perpetual calendar device according to claim 1 wherein said inner cylindrical member has the month of February displayed or represented twice thereon at first and second locations, the first location being positioned in said first viewing aperture to display or represent February in non-leap years and the second location being positioned in said first viewing aperture for displaying or representing February in leap years, and wherein the date numeral "29" is displayed through said second viewing aperture when the second location is positioned in said first viewing aperture.

3. A perpetual calendar device according to claim 2 wherein said annular member has a short vertical height and is mounted on an interior annular lip located near to but below an upper end of said outer casing.

4. A perpetual calendar device according to claim 3 wherein said inner cylindrical member has an outwardly extending flange located at a top end thereof, said flange being adapted to rest on an upper end rim of said outer casing.

5. A perpetual calendar device according to claim 1 wherein third and fourth apertures are formed in said cylindrical outer casing for displaying data relating to zodiac signs for the month shown in said first viewing aperture and said inner cylindrical member also displays on said exterior surface thereof data relating to zodiac signs, said data relating to zodiac signs being arranged for viewing through said third and fourth apertures after a suitable rotation of said cylindrical member to display a desired month through said first viewing aperture.

6. A perpetual calendar device according to claim 5 wherein said third and fourth apertures are formed at different heights in said cylindrical outer casing and are also spaced circumferentially from one another and wherein said data relating to zodiac signs is arranged in two horizontally extending rows on said inner cylindrical member.

7. A perpetual calendar device according to claim 1 wherein said outer casing has an upper rim section with a horizontally extending gap formed therein, said gap being located directly above said seven vertical columns of dates, said annual member extending across said gap so that data indicating seven days of the week is displayed through said gap.

8. A perpetual calendar device according to claim 7 wherein said data for indicating days of the week comprises at least two similar sequences of representative letters arranged one after the other in a horizontally extending row extending along said annular member.

9. A perpetual calendar device according to claim 1 wherein said outer casing is cup-shaped and has a closed bottom end and said calendar device also functions as a container for holding various objects.

10. A perpetual calendar device according to claim 1 wherein said dates of the month on said outer casing are displayed in five horizontal rows with only the numbers 1 to 3 in a top horizontal row and only the numbers 25 to 28 in a bottom horizontal row, said second viewing aperture being positioned horizontally adjacent to said bottom horizontal row.

11. A perpetual calendar device comprising:

an exterior casing in the form of a hollow cylinder having viewing apertures formed therein, said casing displaying on an exterior surface thereof dates of a month arranged in columns; and a data displaying member in the form of an inner cylindrical member mounted for rotation in said exterior casing and coaxial therewith, said data displaying member displaying on a surface adjacent said exterior casing data relating to zodiac signs, said data relating to zodiac signs being arranged in two horizontally extending rows on said inner cylindrical member, only selected portions of said data relating to zodiac signs being visible through two of said apertures at any one time, said two apertures being provided at different heights in said exterior casing, wherein said data displaying member can be rotated to display through said two apertures data relating to two zodiac signs applicable to a particular month of a calendar year.

12. A perpetual calendar device according to claim 11 wherein said data displaying member also displays on said adjacent surface names of twelve months of the year, said displaying member being rotatable to display a selected single month through one of said viewing apertures other than said two viewing apertures and wherein the visible data relating to zodiac signs is appropriate for the selected month displayed through said one viewing aperture.

13. A perpetual calendar device comprising:

an exterior casing in the form of a cup-shaped, cylindrical casing having viewing apertures formed therein, said casing displaying on an exterior surface thereof dates of a month arranged in columns;

a data displaying member in the form of an inner cylindrical member mounted for rotation in said exterior casing and coaxial therewith, said data displaying member displaying on a surface adjacent said exterior casing data relating to zodiac signs, which data relating to zodiac signs is arranged for viewing through said apertures, only selected portions of said data being visible through said apertures at any one time; and an annular member mounted for rotation in said exterior casing, said annular member displaying data for indicating days of a week, wherein said data displaying member can be rotated to display through said apertures data relating to a zodiac sign applicable to a particular month of a calendar year.

14. A perpetual calendar device comprising:

an outer casing having at least first and second viewing apertures formed therein, said casing displaying on an exterior surface thereof in seven vertical columns dates of a month from number "1" to number "28", said second viewing aperture being positioned to display up to three additional dates of the month after the number "28";

a unitary, rotatable display member mounted in said outer casing for displaying names of twelve months of a year and month ending date or dates for months having more than 28 days, said display member being rotatable to display a current month through said first viewing aperture and correct month ending date or dates for said current month through said second viewing aperture, wherein said display member has a month of February displayed or represented twice thereon at first and second locations, the first location being positioned in said first viewing aperture to display or represent February in non-leap years and the second location being positioned in said first viewing aperture to display or represent February in leap years, and wherein a date numeral "29" is displayed through said second viewing aperture when the second location is positioned in said first viewing aperture; and a further display member mounted in or on said outer casing for displaying data for indicating days of a week above said vertical columns of dates.

15. A perpetual calendar device according to claim 14 wherein said further display member is rotatable, annular, and coaxial with said outer casing which has a cylindrical shape, said further display member being rotatable about a vertical axis to align the days of the week data above appropriate vertical columns for said current month.

16. A perpetual calendar device according to claim 15 wherein said outer casing has an upper rim portion with a horizontally extending gap formed therein, said gap being located directly above said seven vertical columns of dates, said further display member extending across said gap so that data indicating seven days of the week is displayed in order through said gap.

17. A perpetual calendar device according to claim 16 wherein said outer casing is cup-shaped with a closed bottom end and has outwardly projecting holders formed thereon for displaying selected objects.

* * * * *